United States Patent [19]

Caley et al.

[11] 4,097,351

[45] Jun. 27, 1978

[54] PREPARATION OF METAL ALLOY COATINGS ON IRON SUBSTRATES

[75] Inventors: William F. Caley, Halifax; Spero N. Flengas, Willowdale, both of Canada

[73] Assignee: The Governing Council of the University of Toronto, Toronto, Canada

[21] Appl. No.: 765,154

[22] Filed: Feb. 3, 1977

[51] Int. Cl.[2] ..... C25D 13/02

[52] U.S. Cl. ..... 204/181 N

[58] Field of Search ..... 204/181 N

[56] References Cited

U.S. PATENT DOCUMENTS

| | | | |
|---|---|---|---|
| 3,467,588 | 9/1969 | Gebler et al. | 204/181 N |
| 3,844,919 | 10/1974 | Shiota et al. | 204/181 R |
| 3,920,468 | 11/1975 | Brown et al. | 204/181 N |
| 3,936,367 | 2/1976 | Weiss | 204/181 N |

*Primary Examiner*—Howard S. Williams

*Attorney, Agent, or Firm*—Hirons and Rogers

[57] ABSTRACT

Metal oxides such as nickel oxide and/or chromic oxide present as colloidal suspension in a suitable dispersant in an aqueous medium may be deposited by electrophoresis on sheet iron metal anodes. The resulting oxide coatings when reduced in a hydrogen atmosphere at about 1200° C produce an integrated metal alloy coating on iron through interdiffusion.

9 Claims, 9 Drawing Figures

PREPARATION OF METAL ALLOY COATINGS ON IRON SUBSTRATES

FIELD OF THE INVENTION

This invention relates to methods and apparatus for forming metal compound coatings or platings on ferrous metal substrates. More specifically, it relates to the production of integrated iron/nickel and iron/chromium/nickel alloy coatings on iron substrates.

BACKGROUND OF THE INVENTION

The coating of iron objects with a film of stainless steel alloy is undertaken on a large scale in the production of industrial and consumer goods. Such coatings, when properly applied, provide a protective coating against corrosion of the base metal of the object, which is durable and longlasting without requiring large amounts of maintenance, and at the same time decorative and attractive in appearance. Various different processes have been adopted in the past, to effect such coating, but difficulties have been experienced. It is often difficult to achieve the necessary degree of adherence between the base metal and the coating, and to make coatings which do not flake off at higher temperatures. It is also difficult to achieve coatings which are as thin as required, for technical and economic reasons, whilst at the same time obtaining uniform and continuous coatings which properly protect the iron substrate.

BRIEF DESCRIPTION OF THE PRIOR ART

The traditional method of deposition iron/nickel and iron/chromium/nickel coatings on iron substrates is by electroplating, in which the object to be coated is immersed in a bath of an aqueous salt of the metal to be plated. The object is made the cathode in the electrolytic bath and an anode, which may be of the same metal which is being plated or which may be some other chemically unaffected conductor, is used. A low voltage current is passed through the solution, which electrolyzes and plates the cathodic articles to the desired thickness. In electroplating, very careful control has to be exercised over the electrolytic conditions, such as the nature of the substrate metal surface, salt concentration, temperature, current, etc., in order to achieve the desired results. Further, the degree of adhesion between the coatings applied and the substrate is often deficient, since the coating tends to be a self-contained entity and not integral with the substrate.

Attempts have been made to apply chromic and/or nickel coatings to a substrate mechanically, in the form of pastes or powders, and then to diffuse them onto the substrate to form continuous, alloyed coatings by high-frequency induction heating in a vacuum (see, for example, Zemskov and Guschchin, "Chromizing of Steel by High Frequency Induction-Heating in a Vacuum", Diffusion Cladding of Metals, edited by G. Samsonev, Constultants Bureau, New York, 1970). Such a process, however, requires expensive equipment, as well as a source of high frequency current. Furthermore, the mechanical application of the metals before heating introduces the risk of producing an uneven final coating.

The use of electrophoresis, i.e. movement of colloidal particles through a fluid under the action of an electric field, has previously been investigated. It has been reported in the scientific literature (see Sturgeon and Armstrong, British Iron and Steel Association, June 2, 1966) that steel strip has been plated electrophoretically with 5 micron carbonyl nickel power from a suspension thereof in a methylated solution containing 10% water and 1 millimole per liter of aluminum nitrate. Subsequently, the samples required rolling under very high pressure after deposition, in order to obtain satisfactory coatings.

SUMMARY OF THE PRESENT INVENTION

An object of the invention is to provide a novel process by which integrated metal alloy coatings containing iron, nickel and chromium in various proportions may be produced on iron substrates by electrophoretic deposition. Another object is to provide the process for production of "stainless steel" coatings on iron substrates.

Other objects and advantages of the present invention will become apparent from the following detailed description.

Briefly, the present invention provides a process in which, in a first step, metal oxides are deposited by an electrophoretic process on the substrate, using a specially formulated aqueous electrophoretic bath. Then the coating articles are heated in a reducing atmosphere to form the integrated, alloyed coatings of the metal. The resulting coatings have a very good adherence and durability, being alloyed to the substrate metal.

Thus according to the present invention, there is provided a process of applying integrated metallic coatings to ferrous metal substrates, which comprises:

forming a colloidal suspension of at least one metal oxide, in powder form, in an aqueous medium containing suitable dispersant;

immersing in said colloidal suspension a ferrous metal substrate and anodically polarizing the substrate;

electrophoretically depositing a film containing said at least one metal oxide from the colloidal suspension onto said ferrous metal anode;

drying the film deposited on the ferrous metal substrate anode to remove a substantial amount of water therefrom; and heating the deposited film containing metal oxide in the presence of hydrogen so as to reduce the deposited metal oxide to metal and form an integrated coating of said metal on said substrate by diffusion.

The use of electrophoresis for applying coatings offers a number of significant advantages, especially ease of preparation and very low equipment cost. The bath suspensions are aqueous, which not only reduces the fire hazard which is often present when using organic suspensions, but also permits a cleaner film to be deposited, due to the absence of the organic medium itself. Runs can be conducted at room temperature. Additives require in the electrophoresis bath are minimal, comprising only a dispersant and a neutralizing base.

BRIEF REFERENCE TO THE DRAWINGS

DESCRIPTION OF THE PREFERRED EMBODIMENTS

Figure 1:
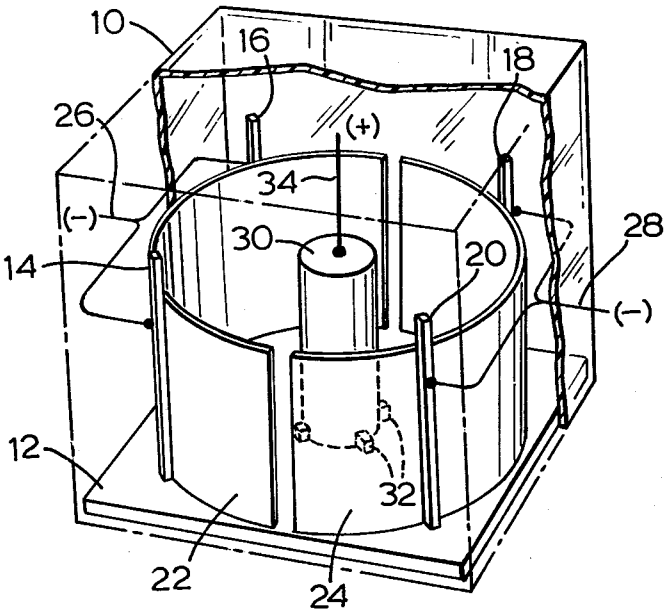
FIG. 1 is a diagrammatic view of an apparatus for conducting the electrophoretic deposition process according to the invention.

The electrophoresis bath is preferable made up with distilled, deionized or other relatively pure water. The dispersant which is used can be substantially any macromolecular compound having water suspending properties and capable of forming a stable aqueous dispersion or latex in water with the oxide powders, and producing an electrophoretic aqueous medium. Polar macromolecular compounds are most suitable, such as acrylic acid polymers and copolymers, carboxylated styrene-butadiene copolymers, epoxy resins, polyamide resins, polyimide resins, polyamide-imide resins, natural rubber latex and the like. Especially preferred is polyacrylic acid having average molecular weight in the range 20,000–80,000, and most preferably of about 50,000.

The electrophoretic bath also contains a neutralizer, which is an organic, non-ionic basic compound. The neutralizer should be a compound which does not lead to evolution of gas at the electrodes during electrophoresis. Suitably such neutralizers are the organic amines, such as triethylamine, monoethylamine, diethylamine, ethylenediamine, and the like. Triethylamine is most preferred.

It is preferred in the process of the present invention to use metallic oxide powders of fine particle size. The preferred size range is from about 1.0 to about 5.0 microns, average particle diameters. In its preferred, more specific aspect, this invention is concerned with production of iron-nickel and iron-chromium-nickel coatings or surfaces on iron substrates, so that the metallic oxide powders are preferably metal oxide $Cr_2O_3$ and nickel oxide NiO. The invention will therefore be further described with specific reference to these oxides, although it will be appreciated that the invention is not limited to use of these specific oxides.

Colloidal suspensions are suitably made by adding the or each metal oxide powder to the dispersant such as polyacrylic acid, in the amount of from about 0.25 to about 1.0 parts by volume of oxide powder, to 1.0 part by volume of dispersant, preferably about 0.5 parts by volume of oxide powder to 1.0 part by volume of dispersant. The mixture can then be diluted with water to make the desired concentration. The neutralizer, such as triethylamine, is then added to raise the pH of the bath to the desired level, which is suitably in the 5–7 range, and is preferably from about 6.0 to about 6.5. The aqueous suspensions are then suitably prepared by mechanical mixing to ensure uniformity and proper suspension, e.g. by use of a high speed mechanical blender. In the process of the invention, suitable potentials for the electrophoresis step are in the approximate range 20–30 volts, at a plating time of approximately two minutes. The current density which is suitably used will be chosen to some extent based upon the nature of the dispersant resin which is used, the size of the micelles, etc. It should not be so high as to cause generation of gases at the electrodes by electrolysis of water during the electrophoresis step. No difficulty will normally be experienced in selecting a suitable current density for operation. A preferred current density will normally be found to be of the order of 0.5 – 1.0 amps per square foot. It has been found advantageous during the electrophoretic disposition, to reverse the direction of current flow briefly, to increase the degree of uniformity and smoothness of the deposited coating.

A typical electrophoretic bath composition for use in the process of the invention might have the following characteristics:

Polyacrylic Acid (M.W. 50,000) . . . 2 volume parts
NiO and or $Cr_2O_3$ (1-5 micron) . . . 1 volume part
Distilled water to obtain a final composition in NiO or $Cr_2O_3$ of 0.2 to 1.0% of oxide powder by volume
Plating Voltage . . . 25 to 30 volts
Current density . . . 0.5 to 1.0 A/ft$^2$
Plating Time . . . 2 to 3 min.
pH of colloidal suspension . . . 6.0 to 6.5

During the electrophoretic deposition, the oxide particles such as chromic oxide and nickel oxide, which are present as part of a colloidal micelle consisting of the dispersant and the neutralizing base, are transported electrophoretically towards the anode. At the anode the colloidal particles shed their charge, and are deposited thereon in the form of a continuous viscous film of substantially uniform thickness. This film is heavily hydrated and contains about 60-70% water at this stage. Next, therefore, the plated articles are submitted to a drying stage, during which the film loses most of its water content and remains on the substrate metal surface as a solid continuous coating.

The next step in the process of the present invention is reduction of the deposited, dried oxide coatings to metallic form, and the alloying thereof with the iron of the substrate. This is preferably accomplished by heating the coated articles to high temperatures, in the range 1,000° C to 1,500° C, in hydrogen. Most preferably the heating of the article takes place in a hydrogen flow, care being taken to exclude oxygen from the system. The time of treatment can be anywhere from about 6–60 hours, as required to effect the necessary reduction to metallic form, and achieve the desired penetration of the alloying elements into the iron substrate metal through diffusion.

During this heat treatment in hydrogen atmosphere, the solid nickel oxide and/or chromic oxide coatings, initially consisting of metal oxide and organic dispersant, are reduced to metallic nickel and/or chromium, and the dispersant residues are thermally decomposed. The products of decomposition are carried away in the hydrogen phase. The metals formed by reduction then diffuse in the substrate iron creating a surface alloy containing iron and nickel, or iron, nickel and chromium, depending upon the composition of the initial electrophoresis bath. Whilst this has been referred to as a coating or plating throughout the specification, it will be appreciated that it is, in fact, an integral unitary alloy surface portion of the article which has been created, conveniently referred to as a coating, but distinguishable from coatings of the type which involve a totally different chemical or physical composition as compared with a substrate upon which they are based. The concentration profiles of the coatings or surface layers of the present invention are such that their surface is rich in nickel, or nickel and chromium, but this concentration decreases with depth to a point where the alloying elements concentration reaches zero. The surfaces of the coatings so formed are substantially uniform.

Thus the present invention provides a process for the production of a stainless steel type alloy by room temperature plating on a given substrate from aqueous suspensions of oxides, followed by sintering under a reducing atmosphere at high temperature. This method of producing a plated alloy has the advantage of affording very good control in the uniformity and thickness of the resulting plating. Whilst the conventional methods consist largely of sprinkling the surface of the substrate to be plated with the desired coating in metallic lpowder form, followed by sintering at the required temperature, so that the uniformity of the resulting plating depends largely on the uniformity of the sprinkled metal powder, by using the technique of electrophoresis, the entire substrate is coated with a constant thickness of deposit. The sample may be withdrawn from the electrophoresis bath at any time, thus regulating the final overall thickness of the deposit. There is of course a limiting factor in that there is a finite thickness of deposit after whick no further material can be deposited. This condition is attained when the sample being plated has received a coating so thick that it is no longer conductive. The oxide coatings being applied are not conducting, so that the resistance of the deposit continuously increases. This is no serious disadvantage, however, since a coating of sufficient thickness to be industrially useful can be deposited with relative ease using the process according to the present invention. The electrophoretic plating reaches all parts of the piece being plated, regardless of its shape. This is of great advantage when plating articles of irregular shape, having corners and holes. Since the plating is carried out at room temperature, no expensive equipment needs to be used to maintain a constant temperature during plating.

The present process may easily be adapted to a continuous operation whereby iron objects to be plated are attached to a steel conveyor belt which circulates between the plating bath and the reducing furnace. In this manner, cycles of plating and reduction operations may be conducted, and alloys of various surface composition and thickness can be obtained.

DETAILED DESCRIPTION OF THE SPECIFIC EMBODIMENT

FIG. 1 of the accompanying drawings illustrates diagrammatically an apparatus for conducting the process of the present invention. The apparatus comprises a tank 10 of electrically insulating material to receive therein the colloidal suspension of metal oxides and the electrophoresis apparatus and article to be coated. The electrophoresis apparatus comprises a base 12 of plastic insulating material which rests on the bottom of tank 10. The base 12 has mounted thereon four similar upstanding metal rods 14, 16, 18, 20 one near each corner of the base 12. The pair of rods 14, 16 has secured thereto an upstanding sheet metal member 22 of semicircular configuration. The pair of rods 18, 20 have a similar upstanding sheet metal member 24 of semicircular configuration secured thereto. The members 22, 24 comprise a cathode for the apparatus, forming an almost complete circle of cathode, resting on the upper surface of the base 12. Electrical connections 26, 28 are provided to each pair of rods 14, 16 and 18, 20 respectively, to polarize the cathodes 22, 14.

The cylindrical ferrous object 30 which is to be coated is mounted substantially at the centre of the circular cathode 22, 24, in guides 32 appropriately positioned on base 12. The object 30 is electrically connected by leads 34 to form an anode. The object to be coated, the anode 30, is thus surrounded by the cathode 22, 24, to give even current distribution and thereby even particle deposition.

The apparatus illustrated in FIG. 1 is specially adapted for the electrophoretic coating of cylindrical objects. It will be appreciated that modifications can readily and simply be made, to make the aparatus more suitable for objects of different shapes. For example, when coating a flat platelike object, a rectangular section plating bath is used, with a flat metal cathode near each end, and the object mounted substantially equidistantly between the cathodes.

The invention is further illustrated in the following specific examples.

EXAMPLE 1

A series of electrophoresis baths was made up of distilled water, polyacrylic acid of average molecular weight 50,000 (the dispersant), triethylamine (the neutralizer), and nickel oxide and/or chromium oxide in the form of powder having particle size diameter from 1.0 to 5.0 microns. The metal oxide was added to the polyacrylic acid in the ratio of 1 volume part of oxide to 2 volume parts of polyacrylic acid. The mixture was then diluted with distilled water to the desired concentration. Triethylamine was then added to adjust the pH of the suspension to about 6–6.5. The mixture was then subjected to thorough mixing a high speed mechanical blender, to prepare the aqueous suspensions.

The objects to be treated were iron objects, in some cases cylindrical and in other cases rectangular plates, of about 5 sq. cm. surface area. They were prepared for plating by boiling for ten minutes in an aqueous 5% phosphoric acid solution, followed by a distilled water rinse. The cylindrical objects were plated in the apparatus shown diagrammatically in FIG. 1, the rectangular samples in a modified apparatus as previously described. The sample was placed a distance of about 3 centimeters from the cathode. The cylindrical samples had a diameter of about 1.6 cm. A potential of 25 volts was applied for each plating for two minutes, and current densities were of the order of 0.5 to 1.0 amps. per sq. ft. The current was reversed twice for 10–20 seconds midway through each plating, as this was found to eliminate points of concentrated film growth, and resulted in each deposit being uniform and smooth.

Three platings were given to each electrode, bringing the total weight of deposits to 150 mg. The coulombic yield was about 3.5 milligrams per coulom. The plated electrodes were dried six hours at room temperature between each plating, and the dry film weight was noted each time.

The plated objects were then suspended inside pure alumina ceramic tubes capped at both ends, and were heated in a silicon carbide furnace and reduced by flowing high purity hydrogen through the tube. Argon gas was flowed before and after the hydrogen flow to ensure that there was no oxygen remaining in the system to mix with hydrogen. Run times varied from 12 to 48 hours, and the temperature range was 1170° C to 1342° C.

The following table gives the bath composition for each run, and other conditions of treatment.

TABLE

| Run No. | Sectional Shape Of Sample | Oxide Used | Oxide Volume Conc. | Reduction Time (Hrs.) | Reduction Temperature (° C) |
|---|---|---|---|---|---|
| 1 | Circular | NiO | 0.2 | 24 | 1342 |
| 2 | Circular | NiO | 0.2 | 30 | 1342 |
| 3 | Circular | NiO | 0.2 | 48 | 1170 |
| 4 | Circular | NiO | 0.2 | 48 | 1250 |
| 5 | Circular | NiO<br>$Cr_2O_3$ | 0.05<br>0.15 | 28 | 1305 |
| 6 | Circular | NiO<br>$Cr_2O_3$ | 0.1<br>0.1 | 52 | 1275 |
| 7 | Rectangular | NiO | 0.3 | 12 | 1342 |
| 8 | Rectangular | NiO<br>$Cr_2O_3$ | 0.05<br>0.15 | 30 | 1275 |

Figure 2:
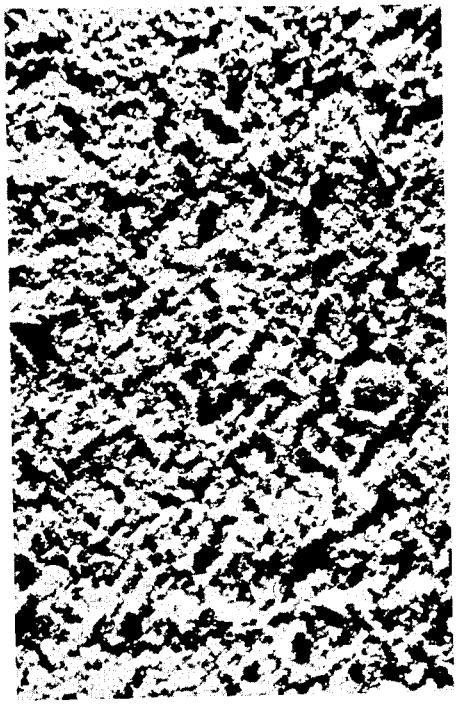
FIGS. 2 and 3 are photomicrographs of the surface of the coatings produced according to some of the examples herein, prior to reduction.
Figure 3:
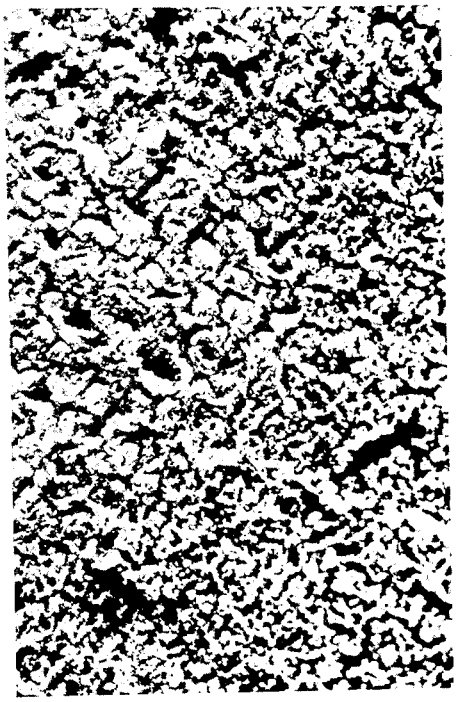

Following that preparation in this manner, the samples of the runs detailed above were subjected to examination and analysis. In each case, the oxides had penetrated to a maximum depth of about 0.5 mm. FIG. 2 is a photomicrograph, at 250 times magnification, of the nickel oxide plated sample of run 7, prior to its reduction with hydrogen, but after drying. It will be noted that the sample surface is substantially uniform. FIG. 3 is a similar photomicrograph of the product of run 8. This sample is also substantially uniform.

Figure 4:
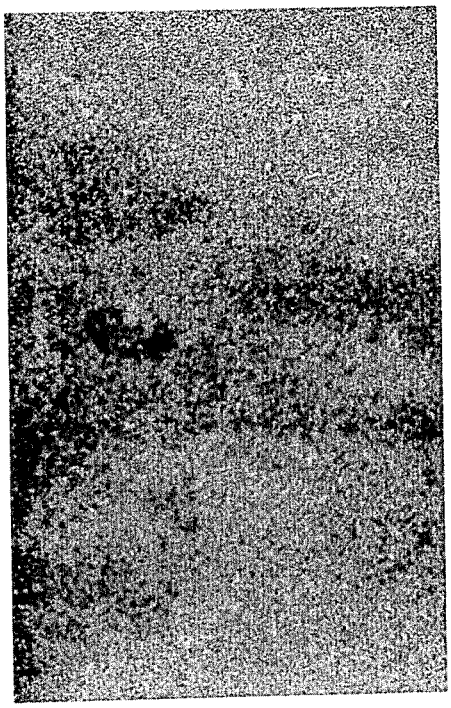
FIGS. 4 and 5 are photomicrographs of the surface of the coatings produced according to some of the examples herein, after reduction.
Figure 5:
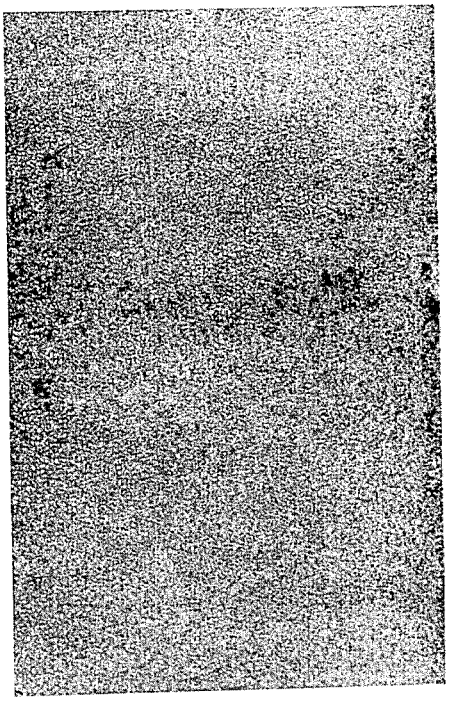

FIG. 4 is a photomicrograph at 20 times magnification of the alloyed surface of the product of run 7, after reduction, showing a nickel-iron alloy at the surface. The uniformity of the surface of the sample is apparent. It is relatively coarse grained. FIG. 5 is a photomicrograph at 20 times magnification of the surface of the product of run 8, after reduction, showing a nickel-chromium-iron alloy at the surface. The surface is substantially uniform and fine grained.

EXAMPLE 2

Certain of the samples plated according to the process of the present invention and reported in Example 1 were subjected to analysis for concentration profiles for nickel or nickel and chromium in their surface layers. This was determined using a three spectometer ARL model electron beam micro probe. The electron beam was 1 micron in diameter and analyses were conducted at 20 Kilo volts and emission currents of 100 micro amps. The standards were the pure metals in each case. A timing device coupled with the scanner permitted the scanner to count for 10 seconds in any one location while taking a traverse.

Figure 6:
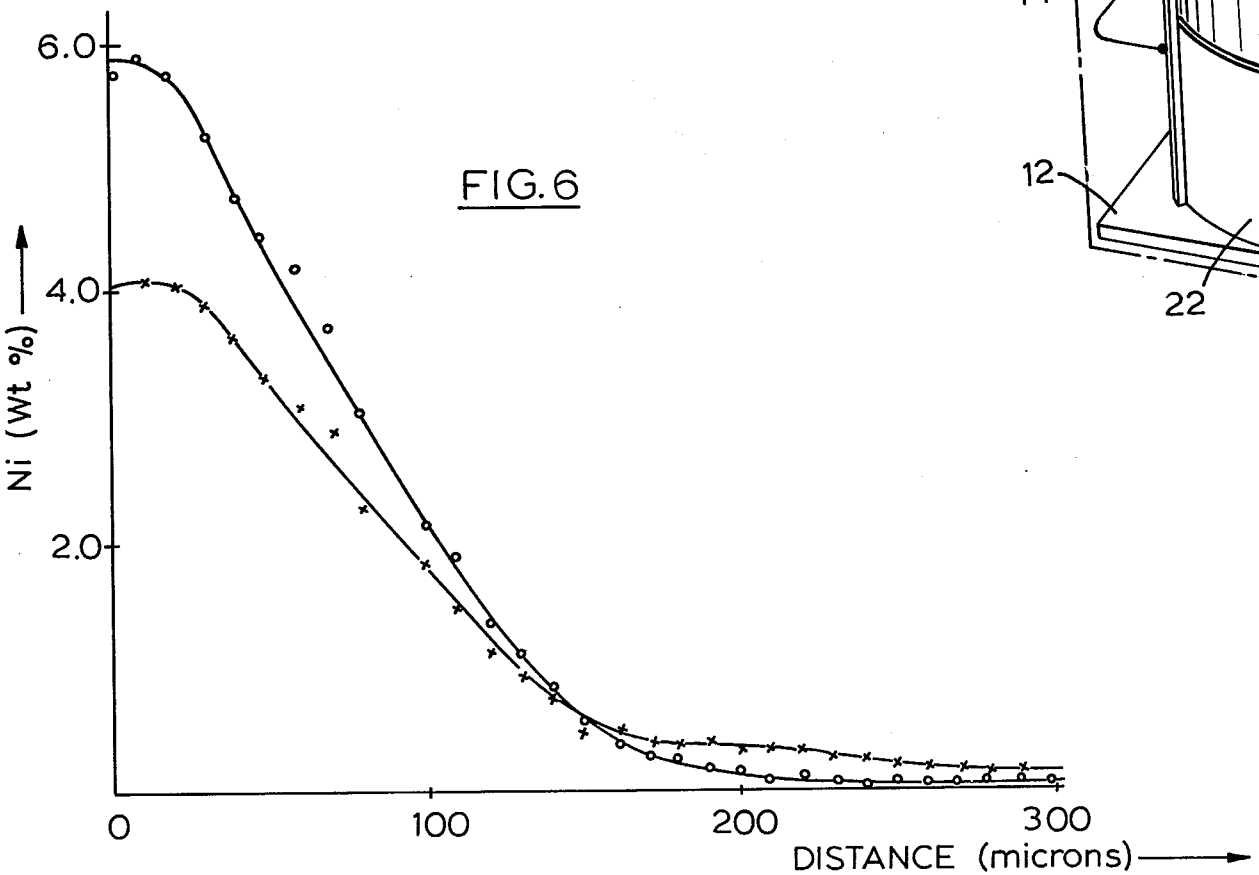
FIGS. 6 and 7 are graphs showing nickel contents at various distances from the coating surface, of products of some of the examples herein.

FIG. 6 shows the results of such analysis conducted on runs 1 and 2 described in Example 1, and is a plot of nickel concentration in the alloyed surface layer against distance from the surface. The upper curve at the vertical axis represents analysis of the sample of run 1, and the lower curve represents analysis of the sample of run 2. This figure tends to show that the nickel-iron alloy zone becomes wider for samples reduced by heating for longer times. The nickel content at the surface is about 3.1% for the sample of run 1, and about 2.2% for the sample of run 2. The balance of the composition is iron.

Figure 7:
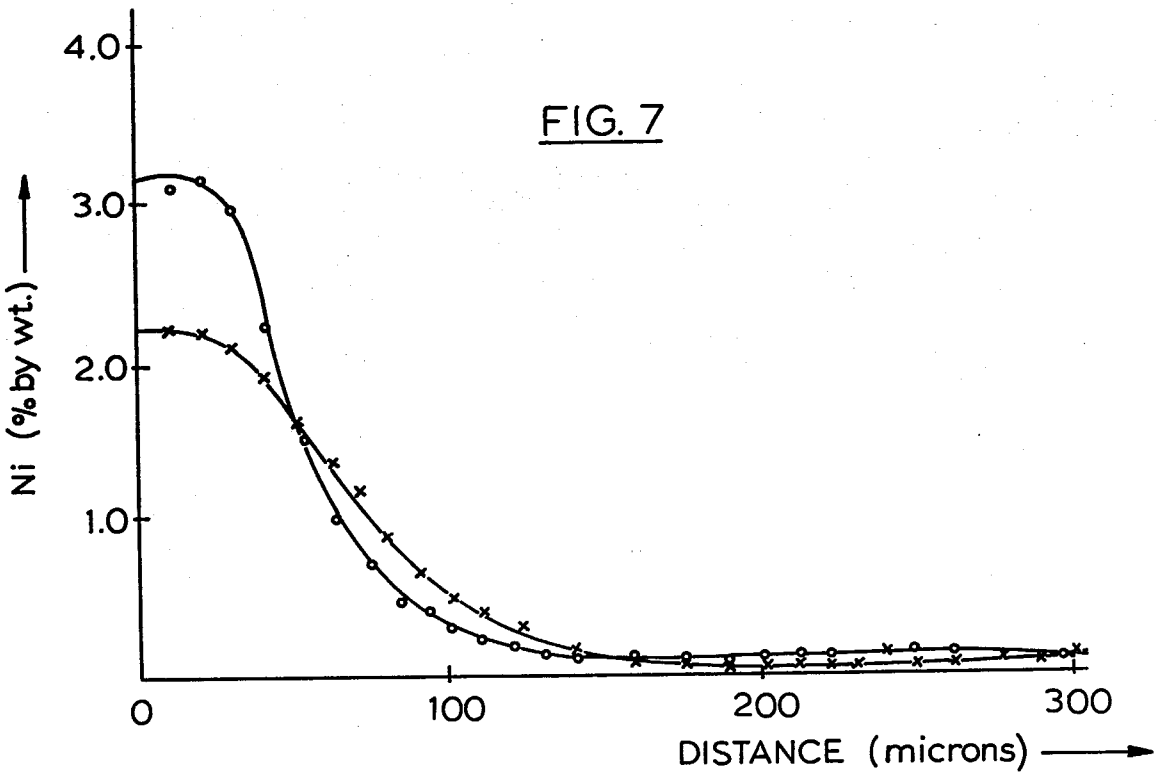

FIG. 7 is a similar graphical representation of the results of such analysis, on the product of runs 3 and 4. The upper curve at the vertical axis is derived from the product of run 3, the curve from run 4. The balance of the composition in each case is iron.

Figure 8:
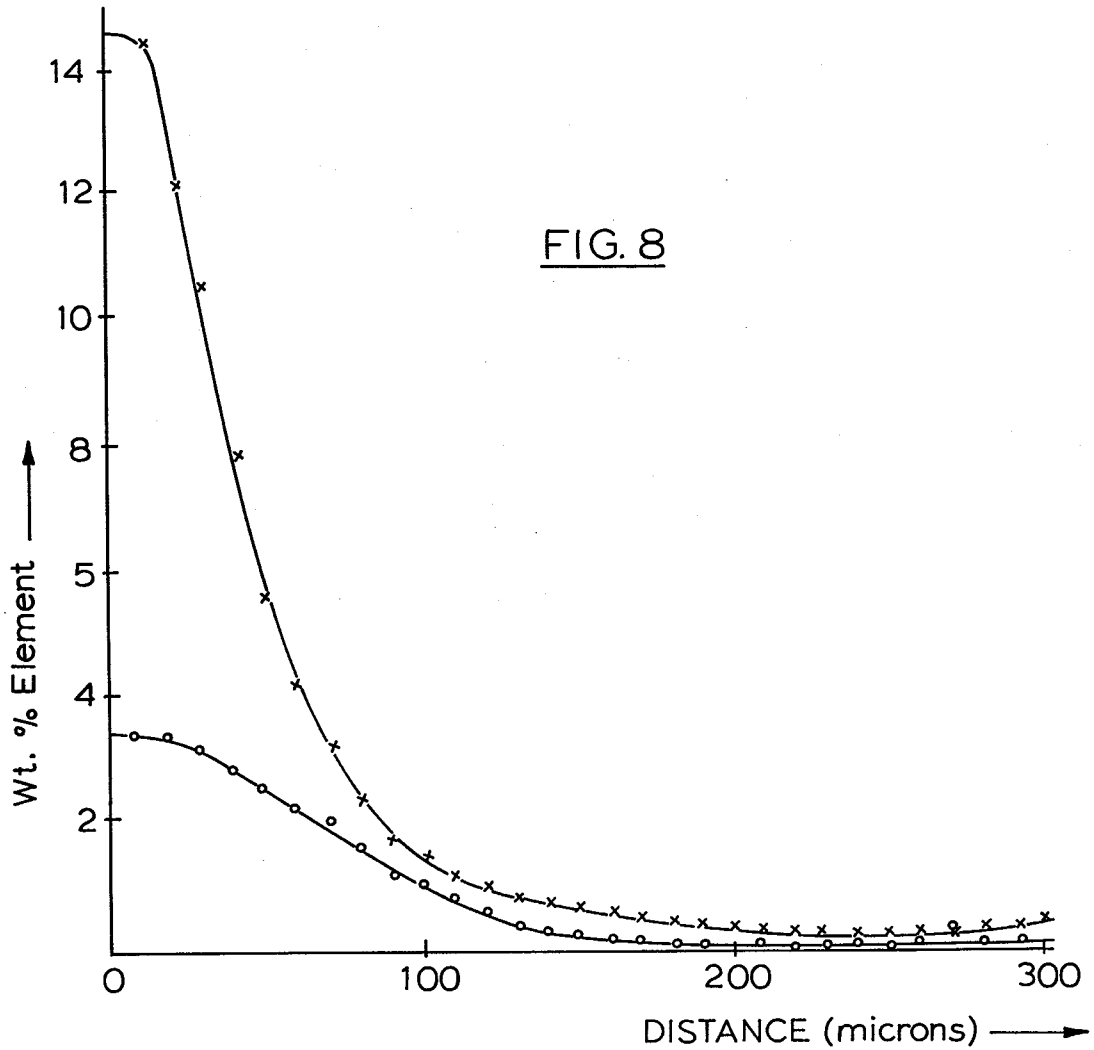
FIGS. 8 and 9 are graphs showing nickel contents and chromium contents at various distances from the coating surface, of products of some of the examples herein.

FIG. 8 is a similar graphical representation of the results of such analysis on the product of run 5. The upper curve represents the chromium content of the alloy at various distances from the surface, and the lower curve similarly represents the nickel content. The balance of the composition in each is iron. Thus, the surface composition of the alloy was 3.5% nickel, 14.4% chromium, balance iron.

Figure 9:
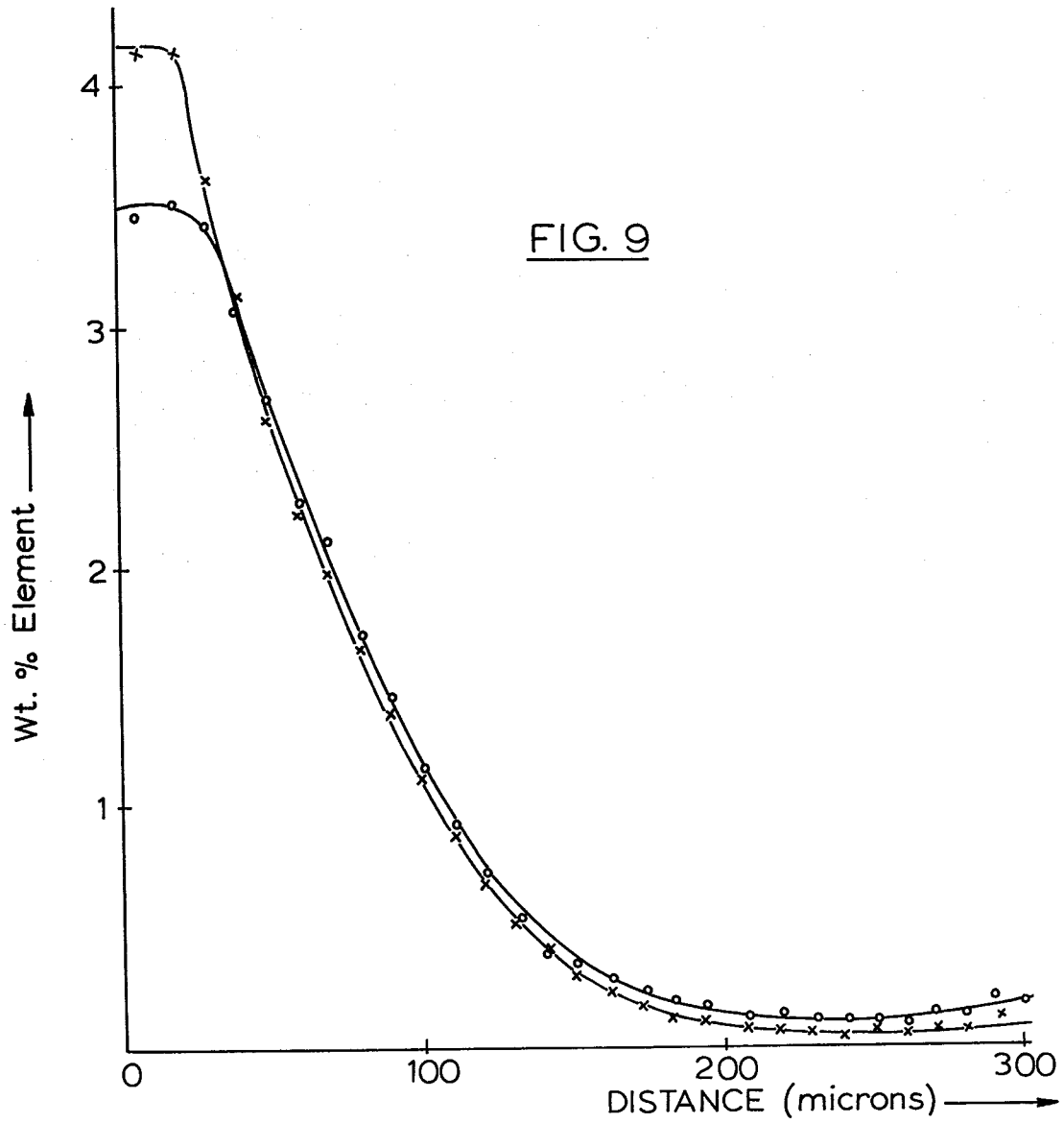

FIG. 9 is a similar graphical representation of the results of such analysis on the product of run 6. In this case, the surface alloy is 3.5% nickel, 4.2% chromium, balance iron.

The concentration profile graphs shown in FIGS. 6, 7, 8 and 9 show clearly that the applied metallic coatings of nickel and chromium have penetrated to a significant depth into the surface layers of the iron substrate. Thus the alloyed surfaces are effectively integral with the surface layers of the substrate, so that the "coating" of nickel-chrome steel is firmly affixed and not removable. It extends over the entire surface of the substrate, is anchored at all locations by integration and hence provides a permanent protective and decorative finish to the substrate.

What we claim is:

1. A process of applying integrated metallic coatings to ferrous metal substrates, which comprises:
   - forming a colloidal suspension of at least one metal oxide selected from the group consisting of nickel oxide, chromium oxide and mixtures thereof, in powder form, in an aqueous medium containing suitable dispersant;
   - immersing in said colloidal suspension a ferrous metal substrate and anodically polarizing the substrate;
   - electrophoretically depositing a film containing said at least one metal oxide from the colloidal suspension onto said ferrous metal substrate anode;
   - drying the film deposited on the ferrous metal substrate anode to remove a substantial amount of water therefrom;
   - and heating the deposited firm containing said metal oxide in the presence of hydrogen at temperatures of from about 1000° C to about 1500° C so as to reduce the deposited metal oxide to metal and form an integrated coating of said metal on said substrate by diffusion.

2. The process of claim 1, wherein said at least one metal oxide has average particle size diameters in the range from about 1.0 to about 5.0 microns.

3. The process of claim 1, wherein after the electrophoretic film deposition and drying steps, the coating article is heated in an atmosphere of hydrogen, for a time in the range from about 6 to about 60 hours.

4. The process of claim 1, wherein the dispersant is a polar macromolecular compound.

5. The process of claim 4, wherein the elctrophoretic bath also contains an organic amine neutralizer.

6. The process of claim 5, wherein the dispersant in the electrophoretic bath is polyacrylic acid having an average molecular weight in the range 20,000 – 80,000, the neutralizer is triethylamine, and the electrophoretic bath has a pH in the range 5 to 7.

7. The process of claim 6, wherein electrophoretic deposition from the bath is accomplished using a potential of from about 20 to about 30 volts, and a current density of from about 0.5 to about 1.0 amps per square foot.

8. The process of claim 7, including the step of reversing the direction of current flow for a brief period during electrophoretic deposition.

9. The process of claim 1 wherein said at least one metal oxide is a mixture of nickel oxide and chromium oxide.

* * * * *